United States Patent [19]

Theis

[11] Patent Number: 5,072,810

[45] Date of Patent: Dec. 17, 1991

[54] GARBAGE STORAGE SYSTEM AND METHOD

[76] Inventor: Erwin C. Theis, 8152 E. Medina Ave., Mesa, Ariz. 85208

[21] Appl. No.: 625,811

[22] Filed: Dec. 11, 1990

[51] Int. Cl.[5] ..... B66B 11/04

[52] U.S. Cl. ..... 187/27; 187/3; 187/62

[58] Field of Search ..... 187/1 R, 3, 27, 20, 187/11, 95, 62, 66; 248/154

[56] References Cited

U.S. PATENT DOCUMENTS

| | | | |
|---|---|---|---|
| 93,452 | 8/1869 | Kiser | 187/3 |
| 3,085,655 | 4/1963 | Van Dyk | 187/3 |
| 3,356,183 | 12/1967 | Shell | 187/27 |
| 4,632,627 | 12/1986 | Swallows | 187/27 |

FOREIGN PATENT DOCUMENTS

| | | | |
|---|---|---|---|
| 565657 | 11/1931 | Fed. Rep. of Germany | 187/3 |

*Primary Examiner*—Robert P. Olszewski
*Assistant Examiner*—Kenneth Noland

[57] ABSTRACT

A garbage storage system for avoiding odors therefrom and for ease of moving a full garbage container to a street curb. This system includes an in-ground silo disposed outside the building and below ground and includes a motor-driven or mechanically operated elevator disposed in the silo and having a switch control adjacent thereto for the motor driven elevator, and includes a container for garbage for placement on the elevator.

1 Claim, 2 Drawing Sheets

GARBAGE STORAGE SYSTEM AND METHOD

This invention generally relates to a garbage storage system and method, and, in particular, the invention relates to a garbage storage system and method having an in-ground silo and elevator and container.

BACKGROUND OF THE INVENTION

A prior art storage system is described in U.S. Pat. No. 1,150,752 issued August 17, 1915. Related patents include U.S. Patent Numbers.

| | |
|---|---|
| 497,922, | issued May 23, 1893, |
| 1,130,080, | issued March 2, 1915, |
| 3,957,137, | issued May 18, 1976, and |
| 4,180,145, | issued December 25, 1979. |

The prior art furnace ash storage system includes a below-floor pit, an elevator, and an ash can, for receiving ashes from under a furnace and for raising the ash can to a furnace floor level.

One problem with the prior art storage system is that it is not able to prevent odors from stored garbage. Another problem is that it is too strenuous to operate by most of the people. A further problem is that it needs a 2-story lift of the garbage container for placing it at the curb for pick-up.

SUMMARY OF THE INVENTION

According to the present invention, a garbage storage system is provided. This system comprises, an in-ground silo disposed below ground outside a building, an electrical drive elevator or a hand actuated mechanical drive, and a container disposed in the silo for storing garbage.

By using an in-ground silo disposed below ground outside the building and by using an electrical power or hand actuated mechanical elevator, the problem of not being able to prevent odors from the stored garage, and the problem of the system being too strenuous to operate, and the problem of lifting the garbage container, are all avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
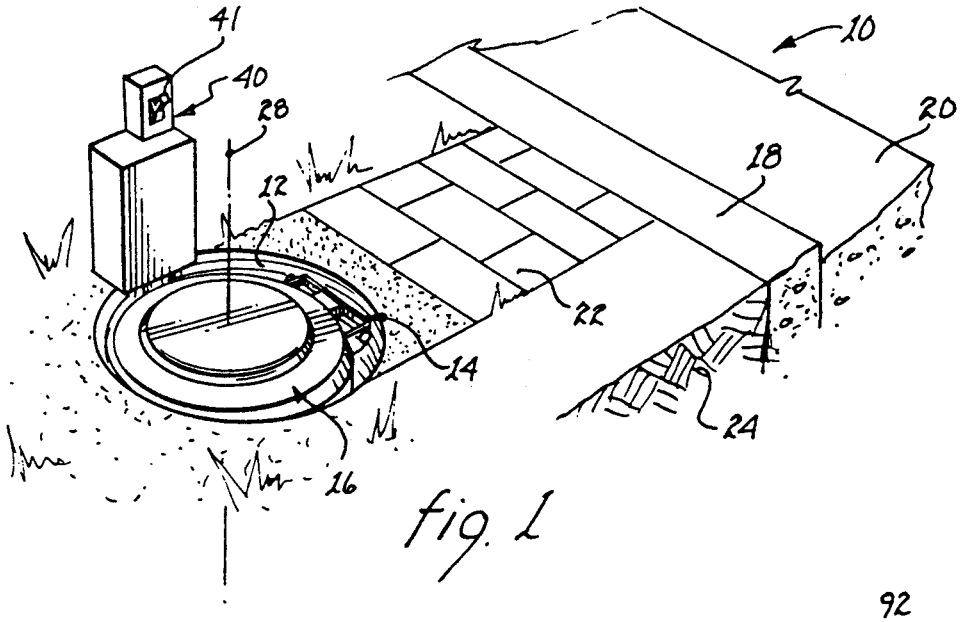
FIG. 1 is a perspective view of the garbage storage system according to the invention.
Figure 2:
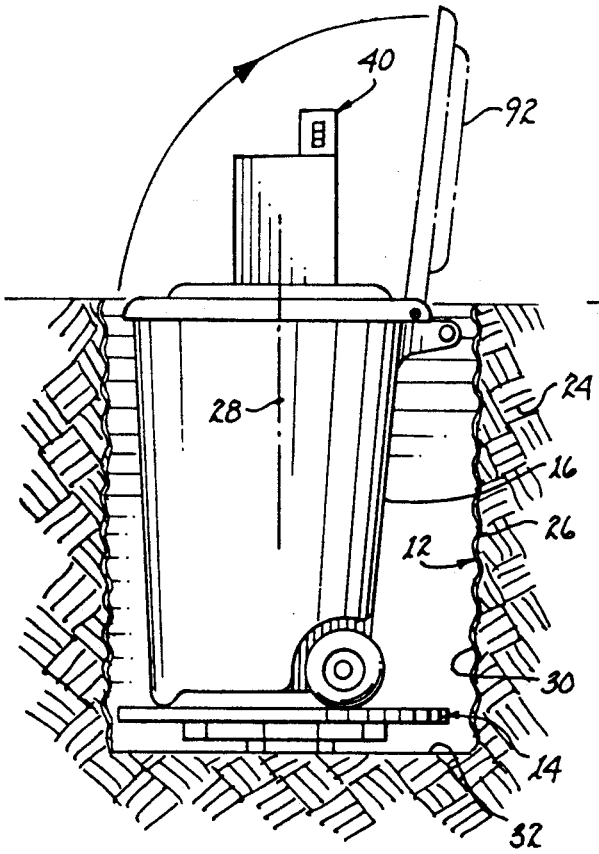
FIG. 2 is a side elevational view of the system showing the garbage container fully in the ground.
Figure 3:
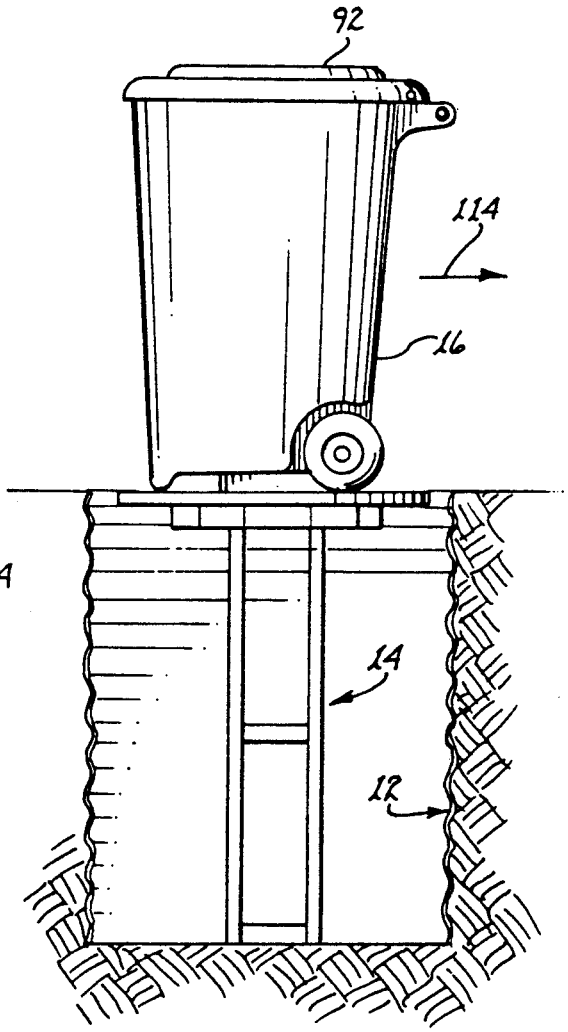
FIG. 3 is a view similar to FIG. 2 showing the garbage container fully elevated.

As shown in FIGS. 1, 2 and 3, a garbage storage device or equipment or system 10 is provided. System 10 has an in-ground or underground pit or silo 12, a power drive elevator 14, and a preferably two-wheeled garbage container 16 for storing garbage.

Silo 12 is preferably disposed adjacent to a curb 18 of a street 20. Silo 12 is also disposed adjacent to a paved area 22 and is disposed in ground 24.

Silo 12 has a cylindrical, open ended, upright, corrugated steel wall 26 (see FIGS. 2 and 7) which has an axis 28 and which is disposed in a cylindrical hole 30 in ground 24 that has a bottom surface 32.

Figure 4:
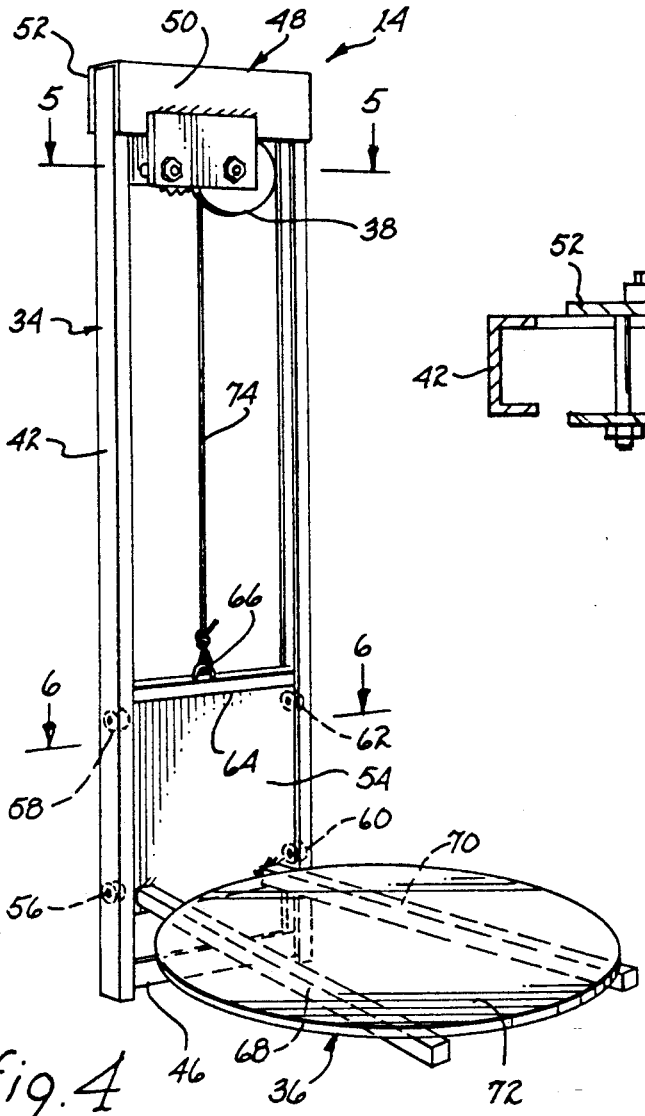
FIG. 4 is a perspective view of a portion of the system of FIG. 1.
Figure 5:
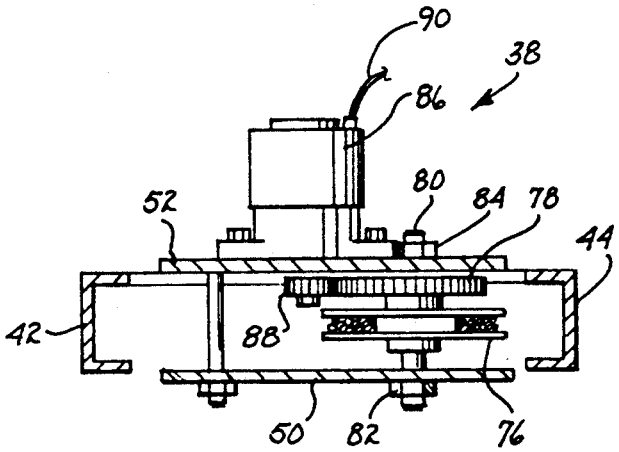
FIG. 5 is a section view as taken along line 5—5 of FIG. 4.
Figure 6:
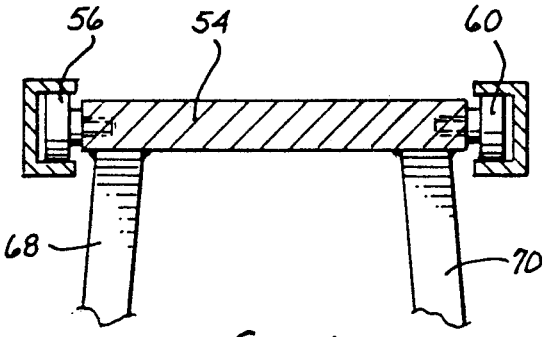
FIG. 6 is a section view as taken along line 6—6 of FIG. 4.

As shown in FIGS. 4, 5 and 6, elevator 14 has an upright guide support 34, a horizontal, vertically movable platform or carriage 36, an electrically powered drive 38 (see FIG. 5), and a control 40 which has a switch 41 (see FIG. 1).

Support 34 has left and right upright channels 42, 44 (see FIG. 4) which are fixedly connected to wall 26. Support 34 also has a bottom transverse brace 46, which is fixedly connected to channels 42, 44, and has a top transverse beam 48, which has front and rear plates 50, 52 that are each fixedly connected to channels 42, 44 and that support drive 38.

Platform 36 has an upright plate 54, which is guided by two left rollers 56, 58 and two right rollers 60, 62 that are received by respective left and right channels 42, 44. Platform 36 also has a top angle 64, which is fixedly connected to plate 54 and which has a U-shaped bar 66 that is fixedly connected to angle 64. Platform 36 also has preferably left and right cantilever beams 68, 70, each of which is fixedly connected at one end to plate 54, and has a circular floor plate 72 which is supported by beams 68, 70.

As shown in FIGS. 4 and 5, drive 38 has a cable 74, which is connected at its bottom end to U-shaped bar 66, and has a drive sheave 76, (see FIG. 5) which is connected to cable 74 at its upper end, and which supports cable 74. Drive 38 also has a drive gear 78 which is fixedly connected to sheave 76, and has a pinion or shaft 80, on which sheave 76 and drive gear 78 are journaled. Pinion 80 has front and rear end bolts 82, 84. Drive 38 also has an electrical motor 86, which has a motor gear 88 that meshes with drive gear 78, and has a conductor 90 for connection to control 40 (see FIG. 1).

Container 16 has a lid 92 (see FIGS. 2 and 3) which is normally closed as shown in FIG. 1. Lid 92 is opened for depositing garbage in container 16 as shown in FIG. 2.

Figure 7:
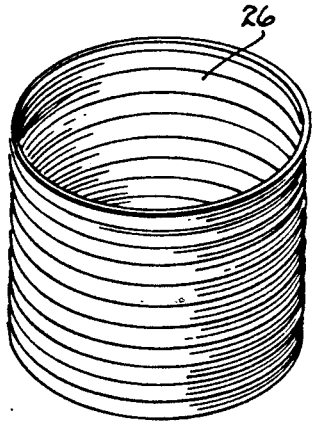
FIG. 7 is a perspective view of the casing that is located in the ground surrounding the garbage container shown in FIG. 2.
Figure 8:
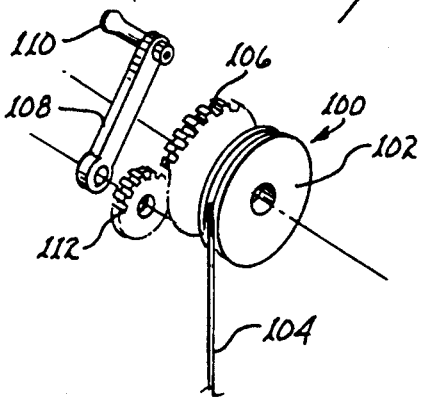
FIG. 8 is a perspective view of an alternate mechanical embodiment of the electrical drive embodiment of FIG. 5.

As shown in FIG. 7, if desired, alternatively a manual drive 100 is provided in place of an electrical drive. Drive 100 includes a drive sheave 102, a cable 104 which is connected at its upper end to sheave 102, and a drive gear 106 which is fixedly connected to sheave 102. Sheave 102 and drive gear 106 are journaled on a pinion (not shown). Drive 100 also has a crank 108 which has a handle 110 that is fixedly connected to crank 108, and has a crank gear 112 which meshes with drive gear 106. Drive 100 can be used permanently on system 10, or drive 100 can be used temporarily on system 10 when motor 86 is being repaired, or the like.

FIG. 1 shows container 16 with lid 92 closed. FIG. 2 shows container 16 in silo 12 with lid 92 opened. FIG. 3 shows container 16 in its raised position at ground level with lid 92 closed, and container 16 is ready to move in direction 114 away from silo 12.

The advantages of system 10 are indicated hereafter.

(A) The problem of odors from stored garbage is avoided.

(B) The problem of strenuous work of moving a full garbage container to a street curb is avoided.

(C) The problem of lifting a full garbage container is avoided when moving the container to the street curb.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A garbage storage device comprising, in combination, a wheeled garbage container and a drive elevator to lift the wheeled garbage container; the drive elevator has upright guides which are fixedly connected to a cylindrical, open ended, steel wall; the steel wall is positioned in an underground pit adjacent to a curb of a street; the drive elevator has a platform coupled to the upright guides by an upright plate; the upright guides are positioned substantially within the underground pit except for an uppermost end which support a single cable drive; the single cable drive is positioned above the underground pit and is provided with an electrical or manual drive means to actuate the single cable drive; the single cable drive lifts and lowers the platform; garbage is stored within the wheeled garbage container while the wheeled garbage container is supported by the platform in its lowered position within the underground pit to avoid the problem of oders adjacent a house; the drive means would be actuated to list the platform to a level such that the wheeled garbage container would be moved in a direction off and away from the platform and closer to the curb of the street; this avoids the problem of strenuous work of moving a full, wheeled, garbage container to the curb of the street long distances from the house.

* * * * *